US007146899B2

(12) United States Patent
Imblum et al.

(10) Patent No.: US 7,146,899 B2
(45) Date of Patent: Dec. 12, 2006

(54) BULLET-RESISTANT HAND-HELD DEFENSIVE OBJECT

(75) Inventors: Ray Imblum, Corona, CA (US); David Sodaro, Santa Ana, CA (US)

(73) Assignee: Magshield Technologies, Inc., Corona, CA (US)

( * ) Notice: Subject to any disclaimer, the term of this patent is extended or adjusted under 35 U.S.C. 154(b) by 105 days.

(21) Appl. No.: 10/861,965

(22) Filed: Jun. 4, 2004

(65) Prior Publication Data

US 2005/0053769 A1 Mar. 10, 2005

Related U.S. Application Data

(60) Provisional application No. 60/482,434, filed on Jun. 4, 2003.

(51) Int. Cl.
*F41H 5/00* (2006.01)

(52) U.S. Cl. ..... 89/36.01; 89/36.02; 89/36.05; 89/36.07

(58) Field of Classification Search ..... 89/36.01, 89/36.07, 36.02, 36.05
See application file for complete search history.

(56) References Cited

U.S. PATENT DOCUMENTS

| | | | | |
|---|---|---|---|---|
| 1,895,197 | A | | 1/1933 | Martinson |
| 3,745,938 | A | | 7/1973 | Hathaway et al. |
| 3,766,865 | A | | 10/1973 | Cutler |
| 3,831,805 | A | | 8/1974 | Yonce |
| 3,848,547 | A | | 11/1974 | Schaefer |
| 3,866,242 | A | | 2/1975 | Slagel |
| 4,016,666 | A | | 4/1977 | Finn et al. |
| 4,153,927 | A | * | 5/1979 | Owens ..... 362/99 |
| 4,285,530 | A | | 8/1981 | Ducourant |
| 4,546,863 | A | | 10/1985 | Kaufman |
| 4,664,967 | A | * | 5/1987 | Tasdemiroglu ..... 428/220 |
| 4,678,702 | A | | 7/1987 | Lancaster et al. |
| 4,919,037 | A | * | 4/1990 | Mitchell ..... 89/36.05 |
| 5,364,679 | A | | 11/1994 | Groves |
| 5,554,816 | A | | 9/1996 | Skaggs et al. |
| 5,622,771 | A | * | 4/1997 | Chiou et al. ..... 428/219 |
| 5,641,934 | A | | 6/1997 | Follett |
| 5,787,820 | A | | 8/1998 | Dittoe |
| 6,170,379 | B1 | | 1/2001 | Taylor |

* cited by examiner

*Primary Examiner*—J. Woodrow Eldred
(74) *Attorney, Agent, or Firm*—Knobbe, Martens, Olson & Bear, LLP

(57) ABSTRACT

A bullet-resistant defensive device is disclosed made up of layers of bullet resistant material layered together and connected along their peripheral edge on a frame to form a planar shield. The shield so formed works such that a bullet striking the shield causes the layered bullet resistant material to flex thereby dissipating the force of the bullet, the material when it stretches transfers the force of the bullet from a shear mode to a tensile mode. One preferred embodiment incorporates the invention into a clipboard box for use by police officers for protecting against head, neck and hand wounds from handguns fired at close range from vehicles. The hand-held, bullet resistant clipboard box holds documents and writing implements, and the bullet-resistant material is located within the clipboard box interior cavity and configured for catching a fired bullet before it can pass through the entire clipboard.

3 Claims, 14 Drawing Sheets

FIG. 18
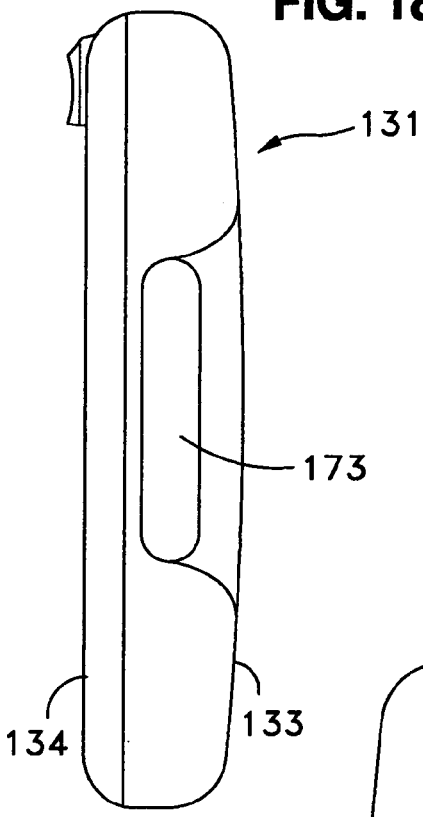
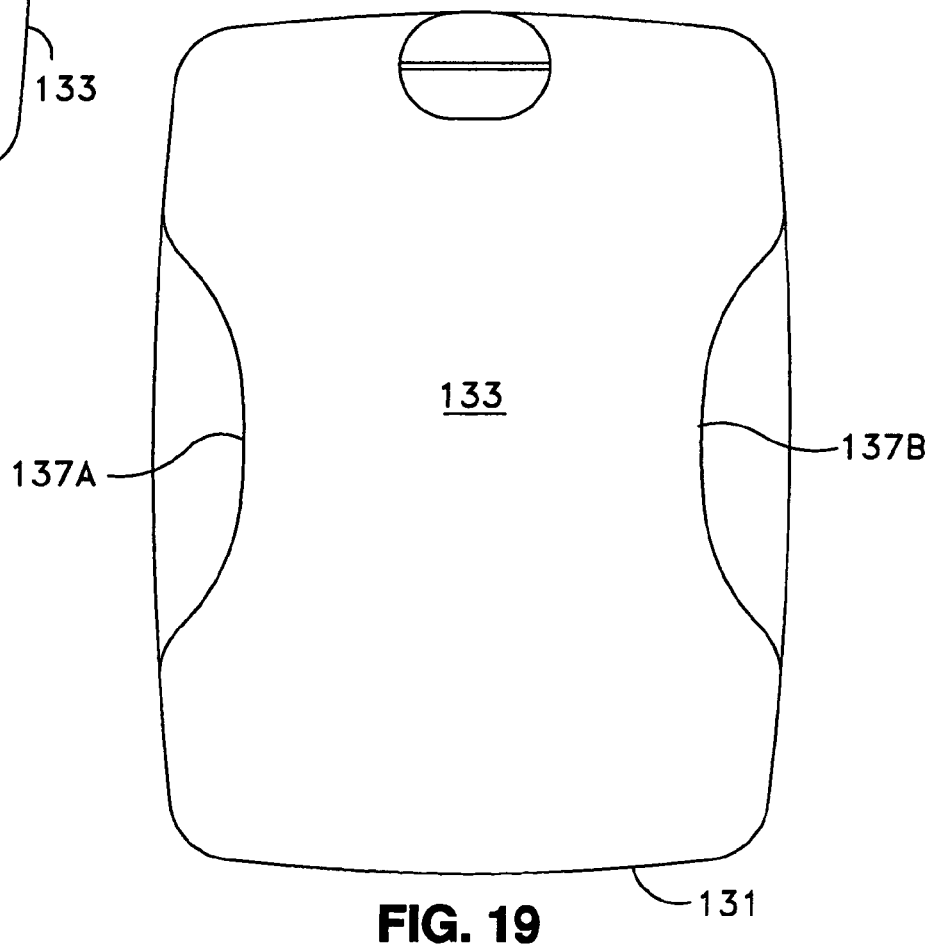
FIG. 19

BULLET-RESISTANT HAND-HELD DEFENSIVE OBJECT

This Application claims the benefit of U.S. Provisioned Application Ser. No. 60/482,434; filed on Jun. 4, 2003 and having the same title as this Application.

BACKGROUND OF THE INVENTION

1. Field of the Invention

The present invention relates to a bullet-resistant hand-held defensive object, such as a head and neck shield, that may be used by law enforcement personnel to protect portions of the body, such as the head and neck, against injury from being shot at close range, as may occur when a police officer approaches a stopped vehicle.

The present invention pertains more specifically to a bullet resistant clipboard box or some similar portable shield like object containing a bullet-resistant material, for example, a plurality of layers of KEVLAR, to protect against injury to parts of the body not otherwise normally protected by other defensive devices, such as bullet-proof vests and the like.

2. Background Description

It is well known that the use of handguns in the commission of violent crimes in American society has increased significantly over the last several decades. No one is more acutely aware of this increase in violent crime by the use of handguns than police and other law enforcement agency personnel. As a result, it has become increasingly common for such personnel to wear bulletproof vests and other such defensive gear, even during the performance of ordinary duties, including, for example, when approaching a vehicle after a traffic stop for a violation of the vehicle code. Unfortunately, under the law in many states, the police officer approaching an occupied vehicle during a traffic investigator is not permitted to approach the vehicle with his handgun drawn unless he or she has probable cause to believe that he or she is in danger of being attacked. Most often, it is not immediately apparent to the officer approaching such a vehicle that his or her safety is in any way in danger. Most such stops occur after an officer witnesses a violation of a vehicle code which is typically is a violation, a category of offers that is less than a minor misdemeanor. Additionally, the vast majority of traffic offenses are committed by generally law-abiding citizens; thus, for the vast majority of traffic stops the officer has nothing to fear. Consequently, in many cases where the driver or other occupant or a vehicle pulls a gun and fires at the approaching officer or officer positioned adjacent the drivers open window, the officer is caught totally by surprise and unaware that such an event will occur. More importantly, even in those cases where an officer approaching a vehicle may be wearing a bullet-proof vest, his entire head and neck as well as various upper body extremities may be exposed. Certainly, at short range, an officer's upper body parts are prime targets for a driver or other vehicle occupant whose principal goal is to mortally wound an officer, leaving the officer lying in the road and pulling away from the scene.

It can, therefore, be seen that there is a need to provide a defensive object which can be held or worn by an officer approaching the vehicle and which is configured to protect the officer's head, face, neck and hands in particular to prevent a mortal wound that might otherwise occur, particularly at such short range and as a result of the violent impact of a bullet with any of such critical body surfaces. Of course, any such defensive device must be practical for use by officers in the normal course of their activities. Otherwise they will not be used and thus irrespective of their effectiveness, will not serve to reduce this problem because officers will simply refuse to use them.

By way of example, some obvious requirements are that such a defensive device be easy to carry, that it be light in weight, that it not interfere with the ordinary activities of the officer, that it not be unduly uncomfortable for the officer to hold or wear, that it not interfere with the officer's ability to observe his surroundings and particularly the person to whom he is speaking after approaching a vehicle, and that it not be considered unduly overprotective and thus embarrassing to the officer or otherwise demeaning of the officer's sense of confidence and authority.

SUMMARY OF THE INVENTION

The present invention solves the aforementioned ongoing need by providing a head, neck and hand shield in the form of a bullet-resistant hand-held defensive object that serves several functions.

One such function is completely oriented to the conventional needs of the police officer, namely having a convenient writing surface and storage container that is sufficiently lightweight to be used on a portable basis, adjacent the vehicle that he or she has stopped. Another such function is to provide a bullet-resistant device which is readily placed between the officer's vulnerable body parts, such as his head, race, neck and hands, and the driver or other occupant of the vehicle who may point a weapon at the officer in a threatening manner.

Still another such function is to provide a bullet-resistant protective box containing a transmitting device having a pre-established recorded message, such as "officer down", "officer needs help", or another form of emergency distress message to the officer's headquarters.

In one of the embodiments disclosed herein, this device comprises what may be called a "clipboard box", also referred to as a "storage clipboard" and which is already in use in various forms and made of various materials for storing of papers, pencils and the like and for providing a flat, hard writing surface upon which a clip holds one or more sheets of paper in a secure manner.

In the variation of the present invention mentioned above the clipboard box or storage clipboard housing, further comprises an internal and/or external bullet-resistant material, such as a bullet-resistant shell and/or a large number of separate layers of ARAMID fiber fabric, such as KEVLAR. In a preferred embodiment of the present invention, comprising a composite layered structure, such layers are installed in the clipboard box and are configured in a manner for effectively absorbing the energy of a fired bullet and also capturing a high speed bullet, in a manner similar to the way in which a catcher's glove catches a high speed baseball.

More specifically, in the present invention, a number of separate layers of KEVLAR, or comparable ballistic material, are stitched together and are adhesively secured at their edges. Then the side layers of the composite layered structure are attached to the lower interior side surfaces of the clipboard box cavity.

The strength advantage of KEVLAR fabric in tension when compared to its shear strength can be readily observed in that KEVLAR shear strength is 14,521 psi., while KEVLAR tensile strength is 424,000 psi. The fabric orientation mode change is accomplished by permitting the fabric to stretch into the ½"–1" air gap created between the composite fiber structure and the upper surface of the box inner cavity.

As the fabric is stretched by the bullet, the fibers give and are changed from a 14,521 psi shear mode to a 424,000 psi tensile mode condition, thereby increasing the bullet penetration resistance by a factor of 29.2 to 1.

Attachment to the box cavity upper sidewalls of the fabric layers along only the edges thereof permits the various material layers to move or slide relative to one another and be displaced into the interior vacant space of the clipboard box cavity to most efficiently absorb the energy of the bullet over time. Furthermore, the attachment of the composite layered fabric structure to the sidewall lower box interior surface creates a ½" to 1" air space between the upper surface of the composite layered fabric structure and the upper interior surface of the box inner cavity. Consequently, the bullet will not pass through the bullet-resistant clipboard box and will have its energy reduced and dissipated so significantly that the bullet cannot cause a serious wound to the police officer, nor cause damage to internal devices contained within the protective box. The KEVLAR fabric fibers are stretched by the bullet striking the fabric, thus placing the fibers in a tensile stretch mode, as opposed to the standard shear strength mode as indicated in prior art patents.

In a variation clipboard box, there are provided one or more devices selected from the group of devices comprising an emergency transmitter, a mini-video camera, a pressurized container of chemical agent, a light source and a TASER. The chemical agent may include tear gas, MACE, pepper spray or a chemical dye for discoloring the body and clothing of a suspect for subsequent identification purposes, and may include mixtures of two or more of such agents where available. The light source may include one or both of an illuminating light and a high intensity light for causing temporary blindness and/or disorientation of a suspect. In another variation, the bullet-resistant clipboard box is constructed with side edge recesses into which a users fingers can be inserted for gripping the box and protecting the user's hands.

In another variation of the invention it is incorporated into a serving tray used by a flight attendant or similarly situated person. Tray has a hollow interior similar to that of the clipboard and the layered material is incorporated into the hollow interior in the same fashion as it is incorporated into the clipboard.

It is therefore a principal object of the present invention to provide a head, neck and hand shield in the form of a hand-held defensive object formed of and/or containing a bullet-resistant material, such as for use by police officers and other law enforcement personnel in protecting certain body parts against mortal injury from even close range firearms, and for signaling for assistance.

An additional object of the present invention is to provide a head and neck shield in the form of a combined clipboard box and bullet-resistant material so that the critical target areas of a police officer approaching a vehicle for a traffic violation can be protected, using an otherwise conventional object that also serves a non-defensive function and which is immediately at hand to signal for assistance in an emergency situation.

It is still an additional object of the present invention to provide an apparatus for protecting the head, neck and hands of a law enforcement official, which regions are not otherwise protected against wounds, despite the presence of a bulletproof vest on the official, the shield of the present invention providing a combined conventional object and bulletproof material, the latter comprising a bullet-resistant exterior or box material and/or plurality of layers of bullet-resistant material located in the interior of the box.

Another object of the present invention is to provide capability for countering violent actions of a suspect and/or provide for subsequent identification of the suspect with devices protected internally within the bullet resistant box.

BRIEF DESCRIPTION OF THE DRAWINGS

The aforementioned objects and advantages of the present invention, as well as additional objects and advantages thereof will be more fully understood hereinafter as a result of a detailed description of a preferred embodiment when taken in conjunction with the accompanying drawings in which:

FIG. 1 is implemented;

FIG. 13*a* showing the installation a first flashlight of normal illuminating power and a second flashlight of temporarily-blinding high intensity light; FIG. 13*b* showing the alternative installation of a debilitating TASER gun; and FIG. 13*c* showing the alternative installation of an emergency transmission device for transmitting to the user's headquarters a preestablished emergency message;

FIG. 18 is a side view of another variation of clipboard that incorporates the present invention;

FIG. 19 is a view of the front of the clipboard of FIG. 18;

In the various FIGS. in a number of instances identical elements and features are given the same reference numbers; in FIGS. 10–15 elements and 30 features similar to those shown in FIGS. 1–7 are given the same reference numbers followed by an "a" and in FIGS. 16 and 17 elements and features similar to those shown in FIGS. 1–7 are given the same reference numbers followed by a "b".

DESCRIPTION OF A PREFERRED EMBODIMENT

Figure 1:
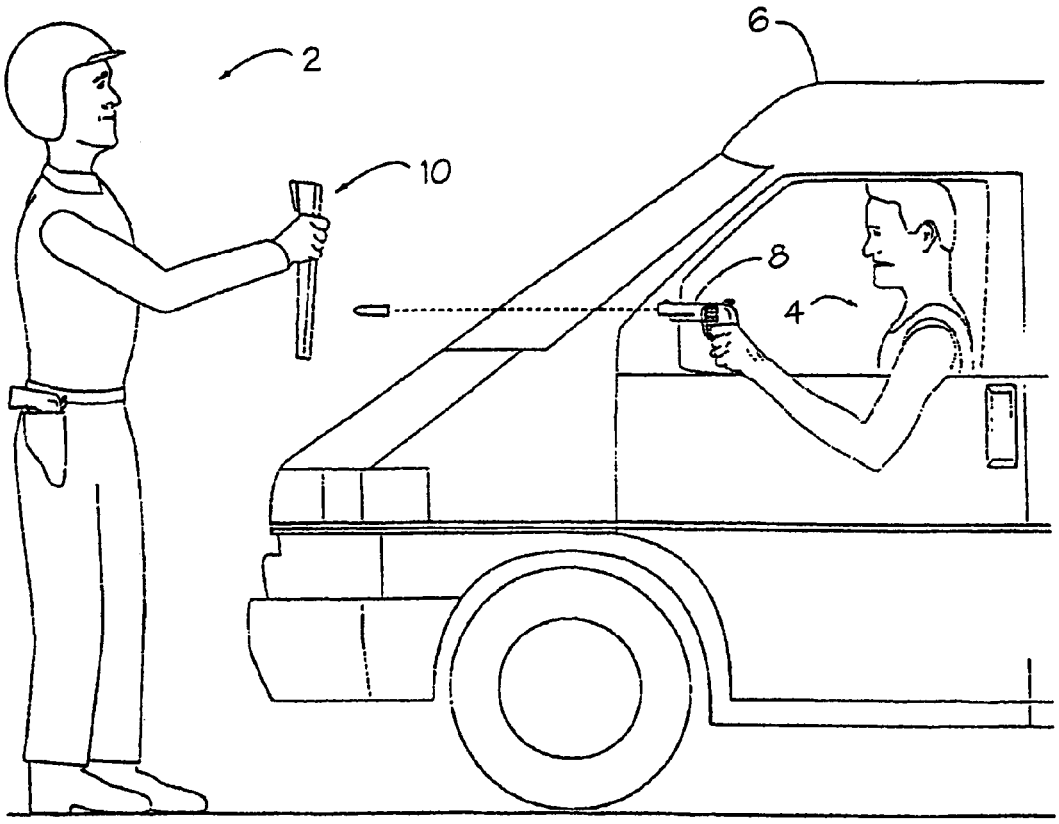
FIG. 1 illustrates a scenario in which a police officer has approached a driver of a stopped vehicle and has deployed the clipboard box of the present invention for defensive purposes.

Referring now to the accompanying figures, it will be seen that a typical scenario where the present invention may be advantageously employed is illustrated in FIG. 1. As shown therein, a law enforcement officer 2 has approached the driver (or other occupant) 4 of a stopped vehicle 6, such as for the purpose of issuing a summons to appear before a magistrate or other judicial officer, due to an alleged traffic violation. Officer 2 may be wearing a bulletproof vest, although the present invention may be utilized even if no such vest is being worn. Unexpectedly, the driver 4 deploys a firearm 8 (for example, a handgun) pointed in the direction of the officer and specifically at the officer's upper body region and especially his neck or head.

At this point, officer 2, who is carrying a head and neck shield in the form of a protective shield 10, configured in accordance with the present invention, places that shield in front of his face so that it is interposed between the likely path of the bullet fired by the firearm 8 and the critical target areas of his face, neck and head. In so doing, officer 2 prevents grave and potentially critical injury to his more vulnerable upper body region from the bullet fired by driver 4.

In addition, shield 10 gives officer 2 the opportunity to back away from vehicle 6 where he has the ability to secure protection against further firing of firearm 8 and to deploy his own weapon to overcome and arrest driver 4.

Figure 2:
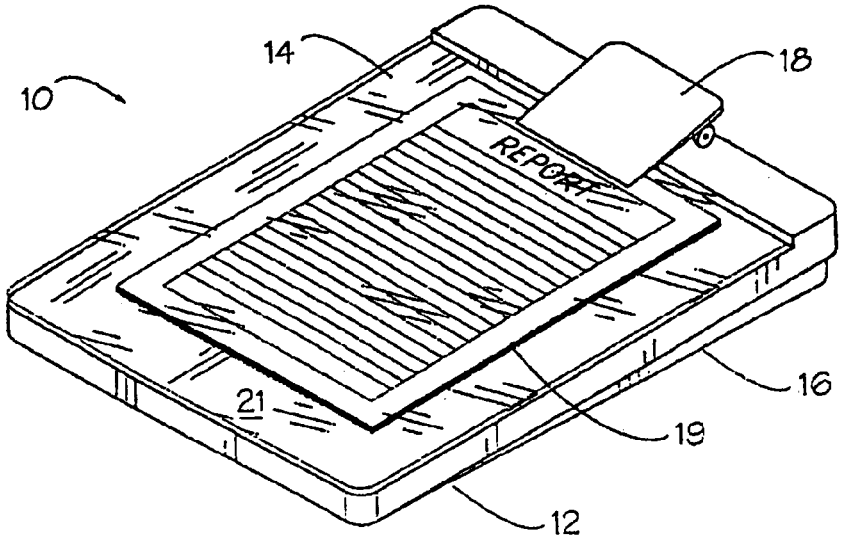
FIG. 2 is a perspective drawing showing the manner in which the clipboard box
Figure 3:
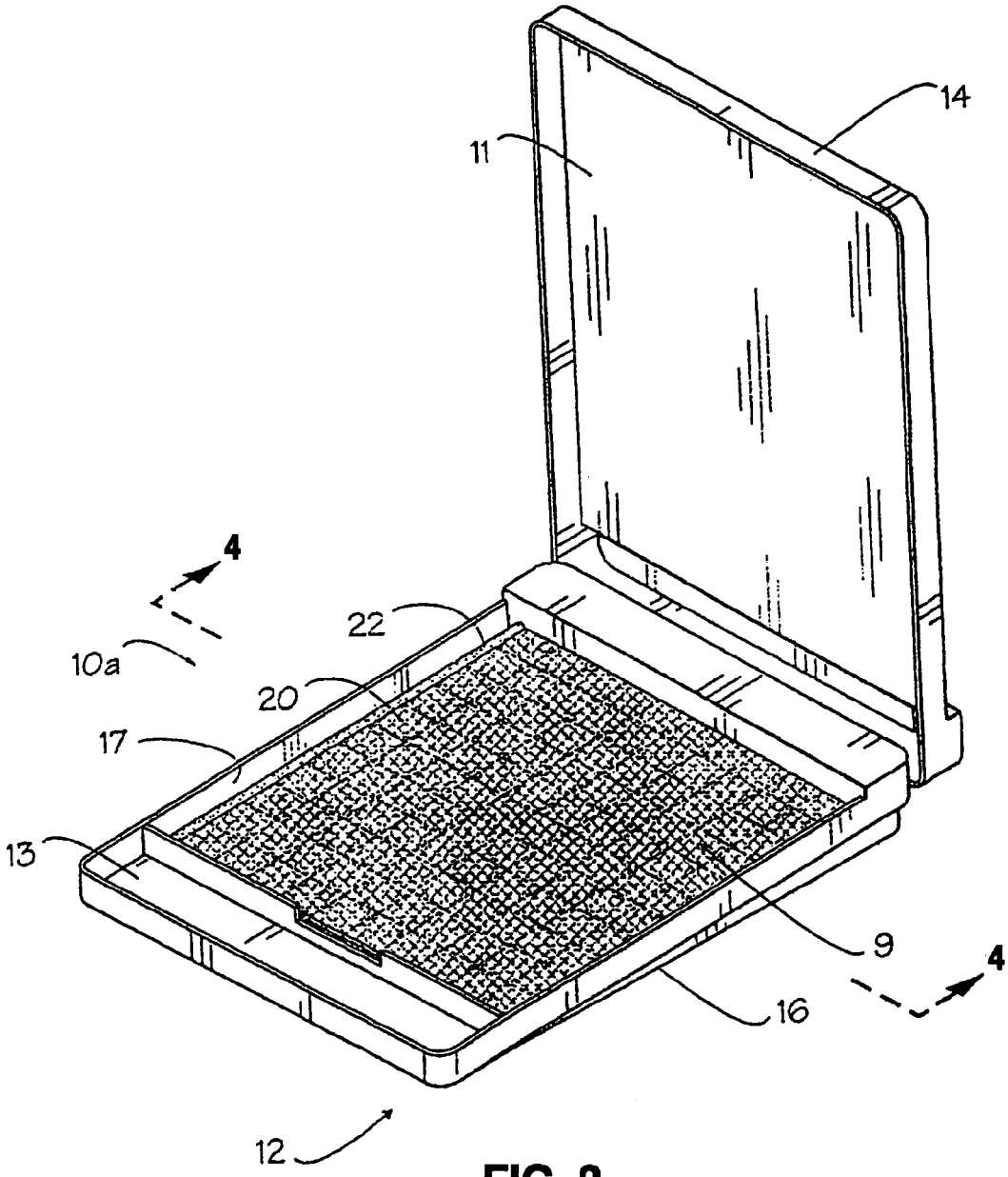
FIG. 3 is a perspective drawing of the clipboard box of FIG. 2, showing the box in its opened configuration and showing bullet-resistant material positioned therein.

Referring now to FIGS. 2 and 3 in particular, it will be seen that the head and neck shield 10 comprises a clipboard box 12 having a front portion or panel 14 including an exterior planar writing surface 19 and a back portion or panel 16.

Clipboard box 12 can be any one of a variety of devices which provide an interior compartment for storage, as well as an exterior flat surface for writing purposes, and a clip device 18 shown in FIG. 2. The present invention may, by way of example with no limitations being intended or implied, be constructed from a Rubbermaid model 1076-45 storage clipboard. Although that particular Rubbermaid model clipboard box may be used, it is preferable to substitute a shatterproof material, such as Dupont Hi-Trel resin material or polycarbonate which is more resistant to shattering in response to the impact of a bullet than is the plastic material currently employed in the aforementioned Rubbermaid storage clipboard.

As seen in FIG. 3, clipboard box 12 is provided with a bullet-resistant material 20 adhesively connected by an adhesive bead 22 along its edge within the interior of the box cavity 9 and more particularly against the lower interior surface 13 of back portion 16. Box cavity 9 is defined by an upper interior surface 11, lower interior surface 13, and the connecting sidewalls 17. The edges of the bullet resistant material can be connected in a variety of other ways including a pressure fit. In one variation a ledge could stick out from the interior surface of the enclosure and hold the edges of the material. In another variation the edges of the material could be force fitted into a grove within the interior edge.

In a preferred embodiment of the invention, bullet-resistant material 20 comprises a plurality of distinct layers of commercial grade KEVLAR, such as at least twenty separate plies of grade 710-29 KEVLAR, preferably stitched together by suitable KEVLAR thread in the manner shown in FIGS. 4 and 5, as will be discussed hereinafter.

Figure 4:
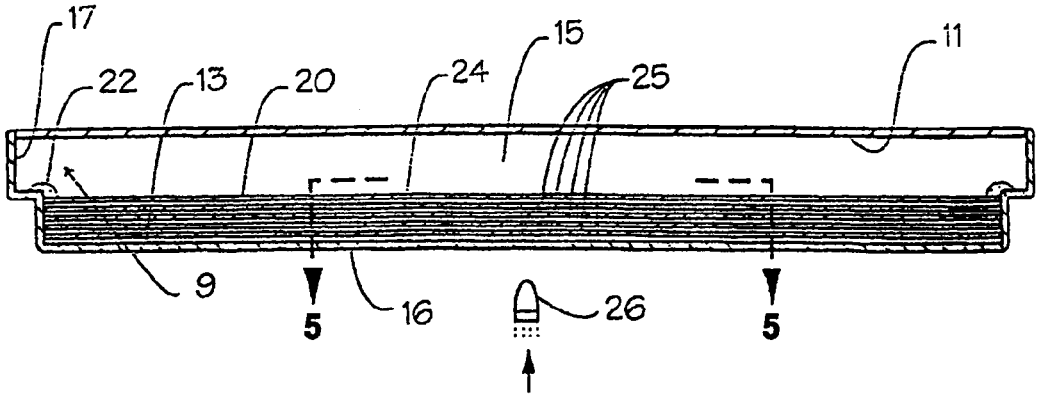
FIG. 4 is a cross-sectional view taken along line 4—4 of FIG. 3, showing the interior of the clipboard box.
Figure 5:
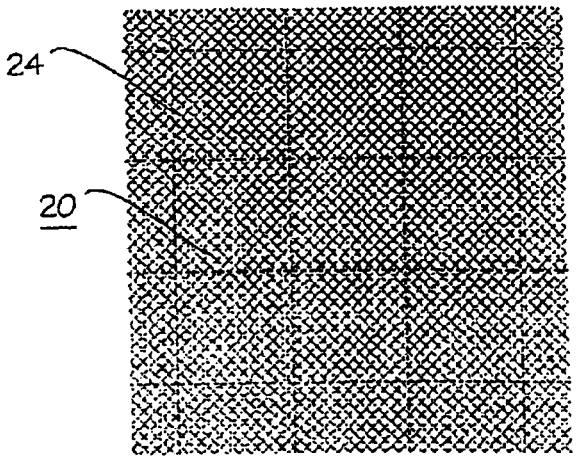
FIG. 5 is an elevational view of the bullet-resistant material used in the present invention, taken along a direction illustrated in FIG. 4 by the arrow labeled 5.

As seen in FIGS. 4 and 5, in the preferred embodiment of the invention shown herein, various plies or layers 25 of KEVLAR fabric are stitched together in approximately 1-inch squares by thread 24. An important aspect of the present invention is that layers 25 of KEVLAR bulletproof material 20, not be overly secured to one another.

More specifically/it has been found advantageous by the present inventor to permit layers 25 of material 20 to be somewhat independent of one another in movement induced by the force (F) of an impacting bullet 26, whereby the bullet-resistant material layers are distorted in a manner with respect to time (t) which more slowly and efficiently dissipates the kinetic energy (KE) of the bullet. For this purpose, it is also important that the material 20 not be secured to lower interior surface 13 of bottom portion 16 along the entire engaging surface thereof, but only along the edge thereof, by a heat-activated adhesive 22. In fact, it has been found advantageous to permit the fabric to respond to the impact force of bullet 26 by the fabric moving away from the interior surface 13 of the back portion 16 in a manner which can best be understood by reference to FIGS. 6 and 7.

Figure 6:
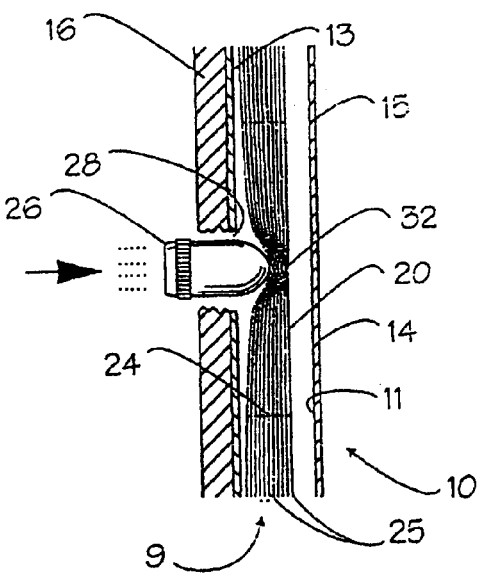
FIG. 6 is a partial cross-sectioned view of clipboard box of FIGS. 1 and 2, depicting the instant a bullet has partially penetrated the back surface of the clipboard box.

As shown in FIG. 6, when bullet 26 impacts the head and neck shield 10 and makes an aperture, into box hollow interior cavity 9, such as back portion hole 28, layers 25 of material 20, despite being sewn together by the KEVLAR thread 24, begin to displace and stretch distort material portion 32 immediately in front of the bullet into box interior force dissipation space 15.

Figure 7:
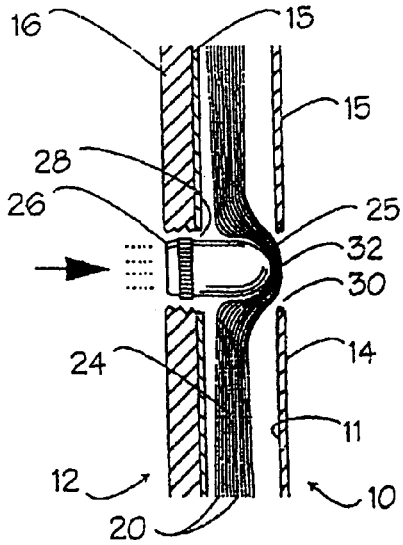
FIG. 7 is a view similar to that of FIG. 6, but showing the configuration of the clipboard box after the bullet has ceased traveling through the box and the bullet is prevented from penetrating the bullet-resistant material.

As seen in FIG. 7, this stretching distortion and relative movement of layers 25 of bullet-resistant material 20 continues as bullet 26 traverses the interior gap expanse (force dissipation space) 15 of clipboard box 12. Material 20 forms a displaced and distorted configuration 32 immediately in front of bullet 26 and thus severely limits and impedes the bullet's travel so that it does not leave clipboard box 12 and does not penetrate the KEVLAR layers 25. Nevertheless, a front portion hole 30 may be formed by the impact of the combination of bullet-resistant material 20 and bullet 26.

Figure 8:
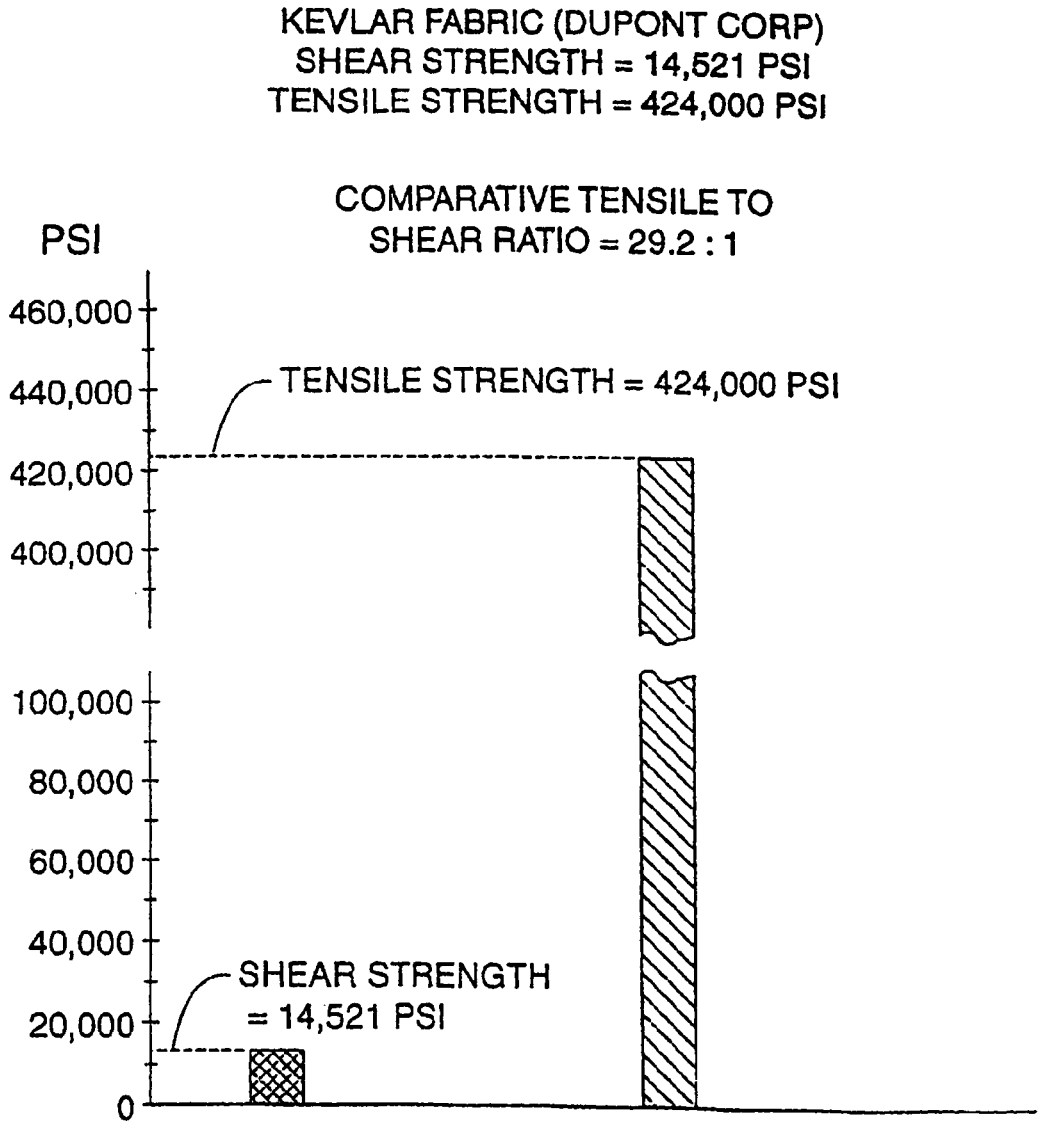
FIG. 8 is a chart depicting the relative difference between KEVLAR (Dupont) shear breaking strength and tensile breaking strength.

As shown in FIG. 8, the fabric layers by being secured to the lower interior surfaces of the box cavity only along the edges of said layers and the box cavity have sufficient cavity interior depth to provide for a force dissipation space defined between the upper layer of said bullet-resistant fabric and the box cavity upper interior surface, thereby allowing the fabric fibers to elongate from their shear 14,521 psi max. mode into their tensile 424,000 psi max. mode condition for dissipating kinetic energy over distance space and time when the box is struck by a fired bullet.

Figure 9A:
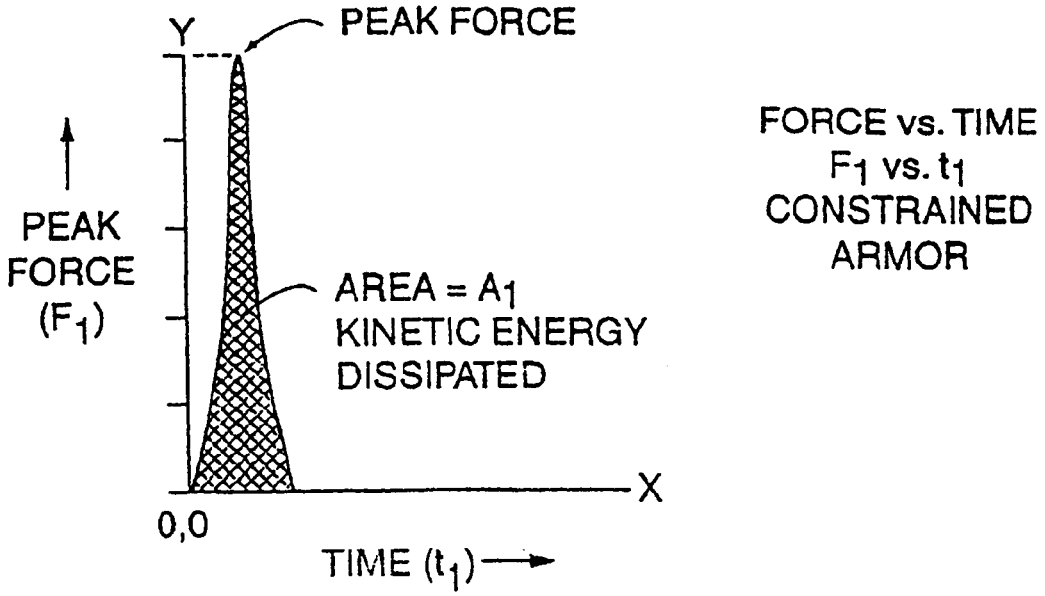
FIG. 9a (PRIOR ART)
FIG. 9*a* is a graph of the prior art "constrained" armor condition of peak force ($F_1$) vs. time ($t_1$)
Figure 9B:
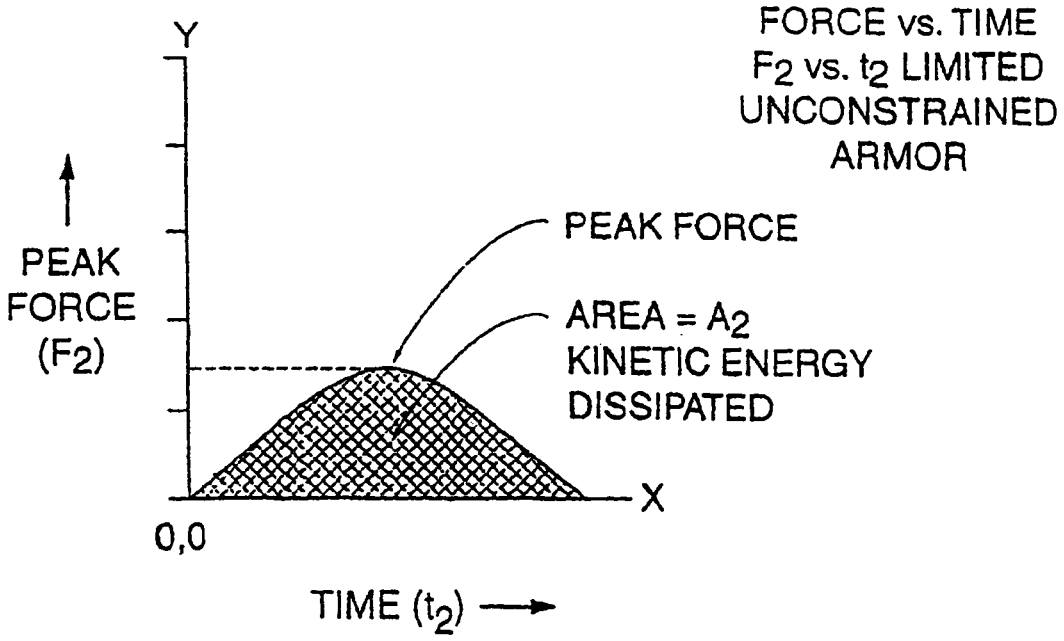
FIG. 9*b* is a graph of the present invention, limited/unconstrained armor condition of peak force ($F_2$) vs. time ($t_2$)

In the prior art as shown in FIG. 9*a*, bullet penetration of a constrained ARAMID fiber fabric exhibits a bullet force ($F_1$) vs. time ($t_1$) curve where the kinetic energy (KE) is equal to $A_1$, the area under the $F_1$ vs. $t_1$ curve which is equal to, and thus the same as, the area $A_2$ as shown in FIG. 9*b*.

The important and distinctive difference between FIG. 9*a* and FIG. 9*b*, is that the peak force ($F_1$) in FIG. 9*a* is a relatively high peak force which may exceed the shear/tensile strength of the ARAMID fabric, while the lower force ($F_2$) in FIG. 9*b* is a time attenuated peak force, and thus in most cases substantially less than the breaking shear/tensile force of the ARAMID fabric.

The box force dissipation space 15 provided behind the bullet-resistant material as shown in FIG. 7, allows the material to distort and respectively move with the bullet 26 through the force dissipation space 15. This air space absorbing provision is unique over the prior art in that this time absorbing space allows the fabric material to effectively absorb and help defeat the forceful (F2) penetration of the bullet 26 in that manner as shown in FIG. 9*b*.

As the ARAMID fabric armor layer moves through the force dissipation space 15, the bullet's kinetic energy is dissipated over a longer time base than if the fabric were restrained, thus more effectively stopping the bullet 26.

Bullet 26 energy dissipated over a short time base generates high peak force (F1) vectors, while energy dissipated over a longer time base generates lower peak force ($F_2$) vectors even though the total kinetic energy (KE) under the FIG. 9*a* and FIG. 9*b* (F) vs. (t) curves are the same. By providing the force dissipation space behind the armor, and allowing the armor to move through this force dissipation space 15 when the bullet 26 is pushing against the armor, decelerates the bullet over space and time thereby towering the peak force ($F_2$).

It is thus evident that the force dissipation space allows the peak force ($F_2$) to be lower, so that more strands of the armor are protected from the critical shear force (14,521 psi) mode that tends to break the fibers.

The force dissipation space 15 allows the armor to distort in such a manner that the fibers form a pocket around the bullet to place the fibers in a tensile strength (424,000 psi) mode, and thus in their strongest orientation position. A bullet stretching the pocket tends to elongate the fibers in an area where they are the strongest. Traditional armor methods place the fibers at a right angle to the bullet 26 when the bullet force ($F_1$) hits the strands of armor on their side and in shear. The force dissipation space 15 permits more of the armor strands to be placed in tension (high strength) rather than shear (low strength), thereby increasing the bullet penetration resisting capability by as much as the ratio of 424,000 psi:14,521 psi or 29.2:1.

Thus, the combination of the force dissipation space 15, the freedom of the armor to move in that space 15, the layers 25 and adhesive attachment tend to allow the fabric to distort with freedom and give within the disclosed system, creating more effective energy dissipation over the prior art.

In practice, it has been found advantageous by the present-inventor to employ a box 12 which is at least ten inches in length and at least six inches in width and which has a maximum depth of less than four inches. The preferred clipboard box 12 shown herein is about thirteen inches in length, about ten inches in width and has a maximum depth of about three inches.

It is preferable to limit the depth to something easily accommodated by a police officer's hands and to provide sufficient length and width to shield at least the head and neck of the officer. Bullet-resistant material 20 should therefore occupy at least one-half and most preferably most of the surface area of writing surface or exterior surface 21 of front portion 14.

In the preferred embodiment, the construction of bullet-resistant material 20 is as follows:

a) KEVLAR ARAMID S710 using 1500 Denier (gm/9000 m) fibers.
b) Each fiber has 1000 individual filaments.
c) The woven fabric is Plain Weave, 24 fibers per inch in both the X and Y (i.e., the warp and woof weaving) directions.
d) 22 plies of this fabric are stitched together using a 1.25 inch "box stitch" pattern having four stitches per inch.
e) Dupont manufactures the fiber, other fabricators, such as Second Chance, weave the fibers into fabric sheets, cut them to size and stitch multiple plies of the fabric sheets together.

Thus it will be understood that the present invention comprises a clipboard box 12 uniquely configured to serve also as a hand-held bullet-resistant shield 10, which may be employed by police officers and the like to protect parts of the body not otherwise protected, such as by bullet-proof vest or the like.

First Variation of FIGS. 10–15:

There is shown in FIGS. 10–15 a variation defensive shield 10*a* principally for use by law enforcement personnel. This variation defensive shield 10*a*, which corresponds generally to above-described shield 10, comprises a variation clipboard box 12*a* which except as specifically described below, is identical with above-described clipboard box 12.

As will become apparent from the following description, clipboard box 12*a* differs from clipboard box 12 in that clipboard box 12*a* includes various devices which provide for defense of the user and for enabling identification of the individual against whom the user is defending himself or herself.

Figure 11:
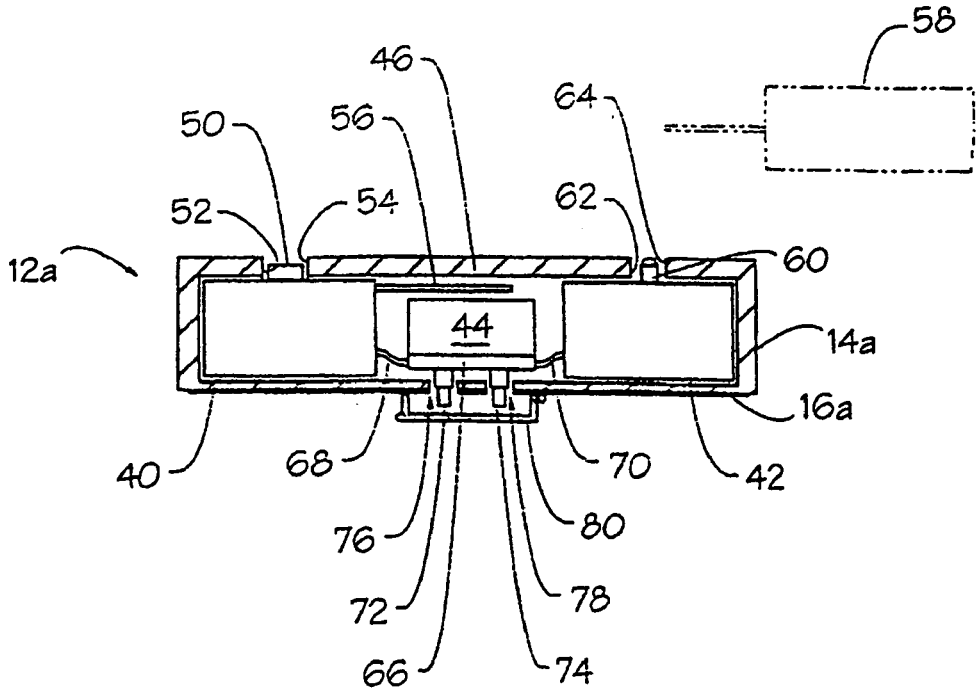
FIG. 11 is a transverse cross-sectional view taken along line 11—11 of FIG. 10, showing installation in upper regions of the variation clipboard box of a miniature video camera with video and audio transmission capabilities and showing a pressurized container containing a chemical agent such as tear gas, Mace, pepper spray, or a suspect-identification dye.

As shown in FIG. 11, there is installed in front portion 14*a* of clipboard box 12*a*. in upper regions thereof, a mini-video camera 40 and a pressurized container 42 containing a chemical agent, such as tear gas, MACE, pepper spray or a liquid dye for discoloring a suspects body and clothes for subsequent identification purposes. Where available, container 42 may contain a mixture of two or more chemical agents of the type mentioned.

Figure 10:
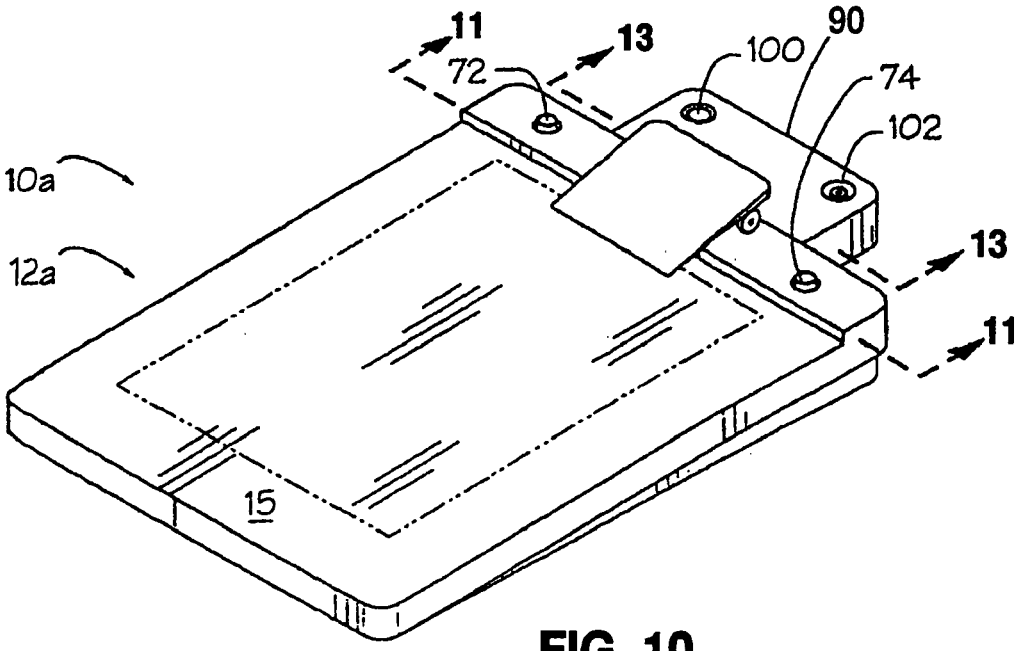
FIG. 10 is a perspective drawing of a variation clipboard box showing a front side thereof.

A battery 44 is provided in front portion 14*a* adjacent video camera 40 and pressurized container 42 and is electrically connected for the actuation thereof by a user of clipboard box 12*a* (as described in FIG. 10 for the pressurized container).

A steel plate 46 is installed over video camera 40 and pressurized container 42 to provide protection for such devices since they are not protected by the above-described bullet-resistant material 20.

As further shown in FIG. 11, a lens portion 50 of video camera 40 is aligned with an aperture 52 in protective plate 46 and a corresponding aperture 54 in box front portion 14*a*.

As also shown in FIG. 11, video camera 40 includes a transmitting antenna 56 which, when the video camera is operating, transmits the received image (in digitized format) to a remote recording device 58 (shown in dashed lines) which may, for example, be located in the user's patrol vehicle.

In a like manner, pressurized container 42 has a dispensing nozzle 60 that is aligned with an aperture 62 in plate 46 and. a corresponding aperture 64 in box front portion 14*a*.

A small electrical or electronic control box 66 is mounted in front portion 14*a* adjacent battery 44 to enable controlling of video camera 40 and pressurized container 42 through respective electrical conduits 68 and 70. Push-button switches 72 and 74 extend through respective apertures 76 and 78 in box back portion 16*a* for operation of video camera 40 and pressurized container 42, respectively. A hinged push-button cover 80 is mounted on box back portion 16*a* over pushbuttons switches 72 and 74 to prevent their unintentional operation.

Figure 12:
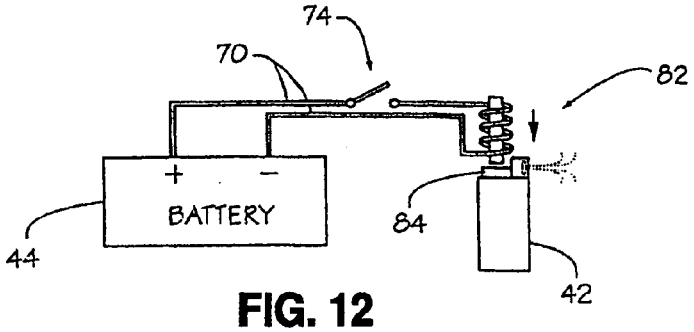
FIG. 12 is an electrical schematic drawing showing one way in which a pressurized container of a chemical agent may be electrically actuated.

FIG. 12 depicts one manner in which pressurized container 5 42 is operated by battery 44 to spray contents of the container toward a threatening individual 4 (FIG. 1). Battery 44 is electrically connected, by conduit 70, to a solenoid 82 which is actuated by the closing of push-button switch 74. When so actuated, solenoid 82 causes the depressing of an actuating switch 84 on container 42.

Figure 13A:
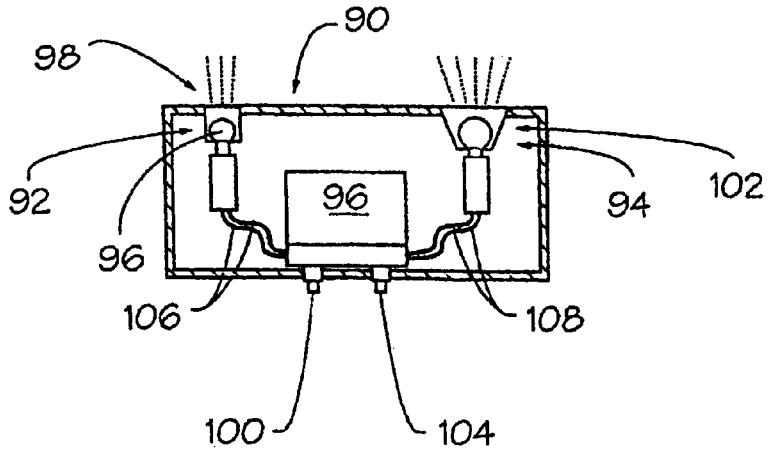
FIGS. 13*a*, 13*b*, and 13*c* are transverse cross-sectional views taken along line 13—13 of FIG. 10 showing an auxiliary portion of the variation clipboard box of FIG. 10.
Figure 13B:
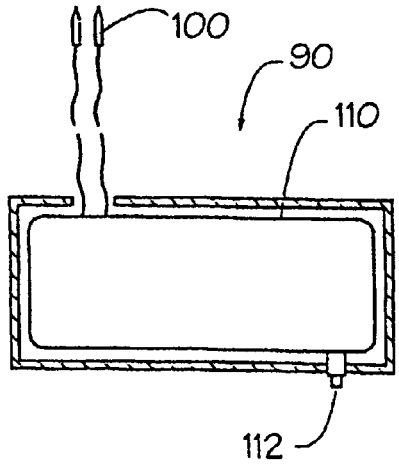
Figure 13C:
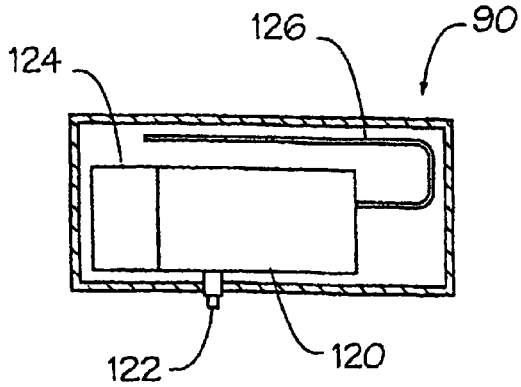

There is illustrated in FIGS. 13*a*, 13*b*, and 13*c* other possible defensive devices that may be used in conjunction with clipboard box 12*a*, and which are installed in a portion 90 at the top of the box. As shown in FIG. 13*a*, there is installed in portion 90 first and second lights 92 and 94 which are powered by a common battery 96.

First light 92 preferably comprises a conventional flashlight bulb 95 which is aligned with an aperture 98 in portion 90 and which provided "normal" illumination, for example, of driver 4 (FIG. 1) when actuated by switch 100.

Second light preferably includes a high intensity bulb and reflector assembly 102 and provides a burst of high intensity light which is intended to temporarily blind and/or disorient driver 4 when activated by switch 104. Lights 92 and 94 are connected to battery by conduits 106 and 108 respectively and are conventionally operated by switches 100 and 104 respectively.

As an alternative to the installation of lights 92 and 94 in box portion 90, there may be installed a TASER 110 (FIG. 13B). As is well known, a TASER (like TASER 110) is operative for firing a pair of darts, which are connected to the TASER body by thin electrical wires. The darts penetrate an individual's clothing or skin and incapacitate the individual by the high voltage provided to the darts by the connecting wires. TASER 110 may be fired by operation of a switch 112.

As another alternative depicted in FIG. 13C, a miniature voice transmitter 120 is installed in clipboard portion 90 for providing preestablished, prerecorded emergency message from the individual carrying clipboard box 12*a*. An emergency message, such as "officer needs help" or "Officer down," may be prerecorded in transmitter and may be sent to the user's headquarters or to a designated receiver by the user by pressing a button 122 or by the force generated by bullet penetration. A battery 124 is provided in portion for operating transmitter 120 and transmitter 120 is provided with a hidden antenna 126.

As seen from FIG. 1, hands of officer 2 are exposed when holding onto edges of clipboard box 12. In such case, the officer's hands may be seriously injured by a shot or shots fired by driver 4, particularly when officer 2 is holding the clipboard box in a defensive position to protect his head and neck, as shown in FIG. 1.

Figure 14:
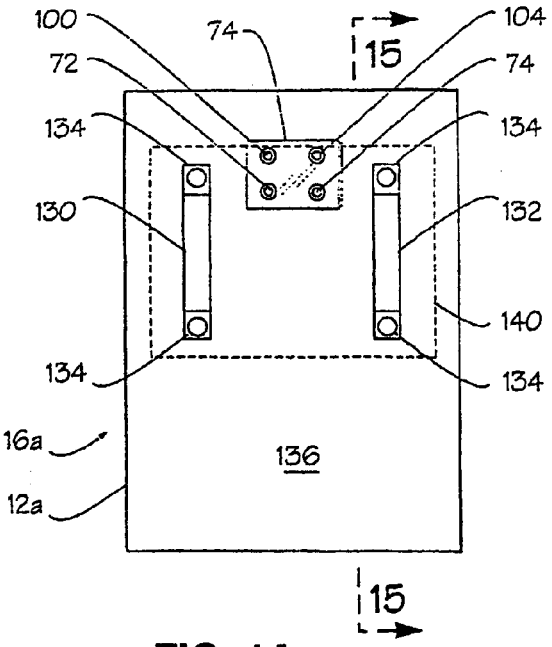
FIG. 14 is a rear elevational drawing of the variation clipboard box of FIG. 10 showing hand-hold straps attached to a back surface of the box.

As shown in FIG. 14 to provide protection for the user's hands, clipboard box 12*a* is provided with a laterally spaced-apart first and second hand straps or brackets 130 and 132 which are attached by rivets 134 to a rear surface 136 of back portion 16*a*.

Hands holding clipboard box 12*a* by straps 130 and 132 with forward writing surface 15 facing driver 4 are protected by ballistic material 20 retained in back portion 16*a*. However, additional protection of the user's hands is provided by a steel back-up plate 140 that is installed by rivets 134 inside of back portion in front of straps 130 and 132.

Figure 15:
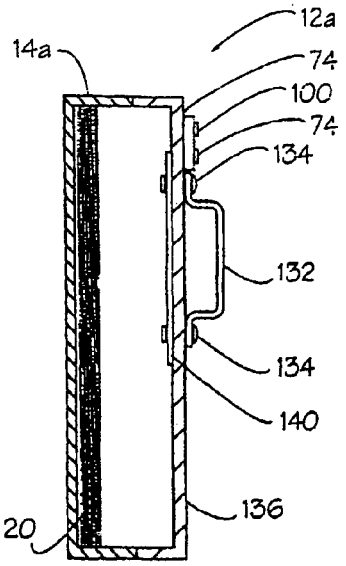
FIG. 15 is a vertical cross sectional view taken along line 15—15 of FIG. 14 showing the manner in which the hand straps are attached to the clipboard box and showing a metal protector for the users hands gripping the straps.
Figure 16:
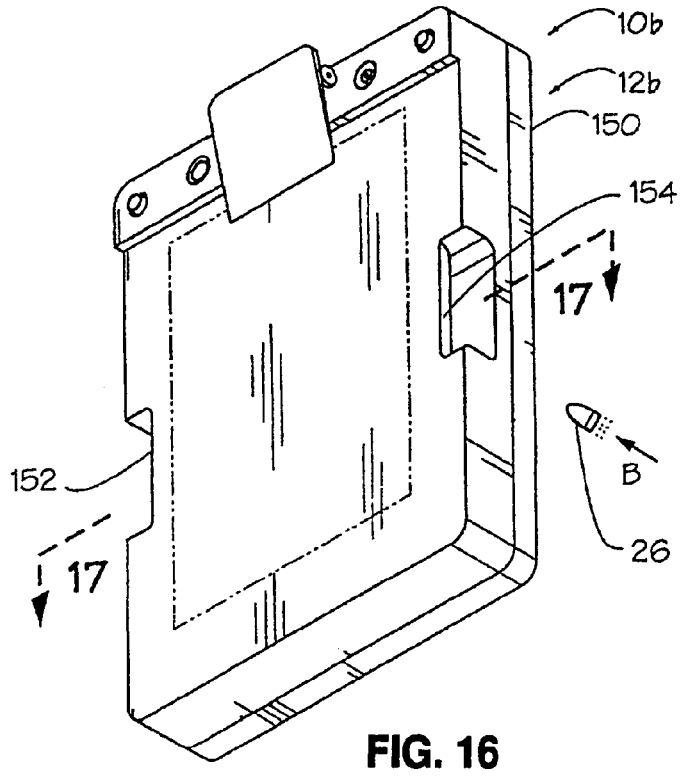
FIG. 16 is a perspective drawing of a second variation bullet-resistant clipboard box showing side edge recesses or hand-holds for enabling a user to hold the clipboard box in an emergency situation.
Figure 17:
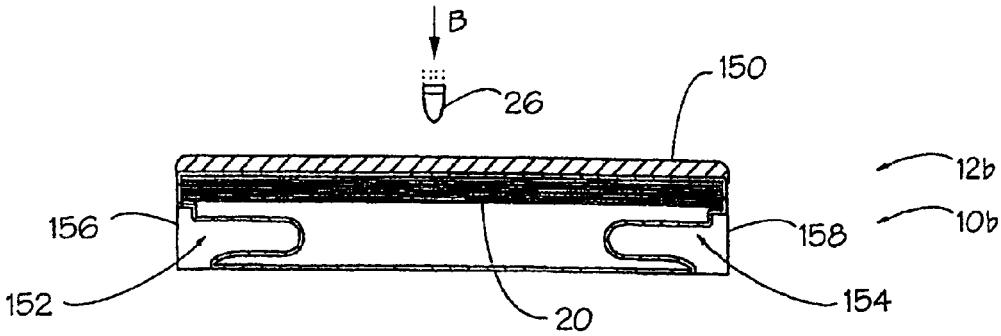
FIG. 17 is a transverse cross sectional drawing taken along line 17—17 of FIG. 16 showing construction of the bullet-resistant box and showing details of the side edge hand holds.

Second Variation of FIGS. 16 and 17:

There is shown in FIGS. 16 and 17 a second variation protective shield 10*b*, which is similar to above-described shields 10 and 10*a* associated with FIGS. 1–13. Making up shield 10*b* is a clipboard box 12*b* having a back 16*b* which may be constructed of a layer 150 bullet-resistant material such as is described in U.S. Pat. No. 5,180,880 as "Spectra Shield", a trademarked material available from Allied Chemical Company. Layer 150 may, for example, be between about ¼ and ½ inch in thickness and may be used in combination with a plurality of KEVLAR bullet-resistant material 20 (FIG. 15).

As shown in FIGS. 16 and 17, left and right hand hold recesses 152 and 154, respectively are formed in respective side edges 156 and 158 of clipboard box 12*b* to enable the box to be gripped in a manner providing the protection of bullet-resistant layer 150 (and KEVLAR material 20, if used) for the user's hands from a bullet 26 traveling in the direction of Arrow "B" toward layer 150 of box 12*b*.

With respect to above-described shields 10, 10*a* and 10*b* which make up respective clipboard boxes 12, 12*a* and 12*b*, it is to be understood that any particular shield and clipboard box provided for use by peace officers may advantageously combine features of two or all of the clipboard boxes. That is, for example, one or more of video camera 40, pressurized chemical agent container 42, lights 92 and 94, TASER 110 and transmitter 120 described relative to shield 10*a* and clipboard box 12*a* may advantageously be installed in clipboard boxes 12 or 12*b*, and that not necessarily are such devices are installed in any of boxes 12, 12*a* or 12*b*.

Furthermore, the type of hand recesses 152 and 154 described above relative to clipboard box 12*b* may also be used in clipboard boxes 12 or 12*a*.

Thus the two variations described above are not necessarily meant to constitute different clipboard boxes per se, but to illustrate what features any particular clipboard box of the present invention may be constructed to have.

Another Variation of the Clipboard

As noted above the clipboard can be configured in a number of different ways. Another variation of the clipboard 131 could be a two part or bifurcated 133 and 134 clipboard, FIGS. 18 and 19. FIG. 18 is a side view of clipboard 131 that shows the two parts 133 and 134 of the clipboard. FIG. 19 is a view of the front of the clipboard with the front section 133 visible. Also, visible are handholds 137A and 137B on the front of the board. As can be seen the handholds are recessed to thereby protect the hands of the officer holding the board with the officers placed into cavity 173.

As discussed and depicted above and below the sheets of bullet resistant material are held within the board in a planar orientation that is parallel to front surface 133 of clipboard 131 depicted in FIG. 19 and perpendicular to plan of the drawings sheet of FIG. 18. As noted elsewhere herein the multiple sheets of bullet resistant material are held at their edges that are at or near the interior edges of clipboard in section 134 and sufficient distance from the surface 133 to allow the bullet resistant material to flex and catch the bullet that might impact surface 134 of clipboard 131.

Figure 20:
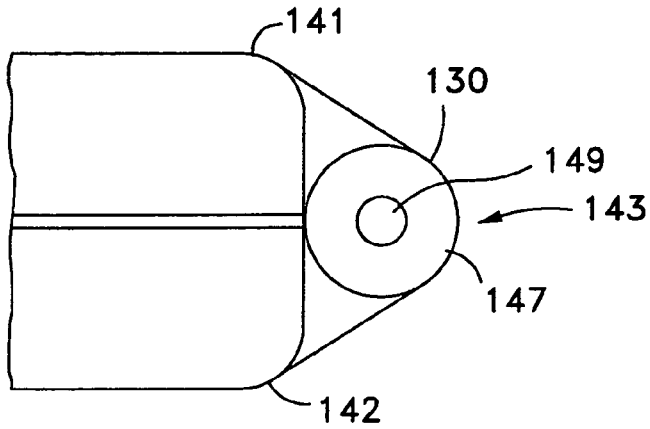
FIG. 20 is a view of an end portion of another embodiment of the present invention.
Figure 21:
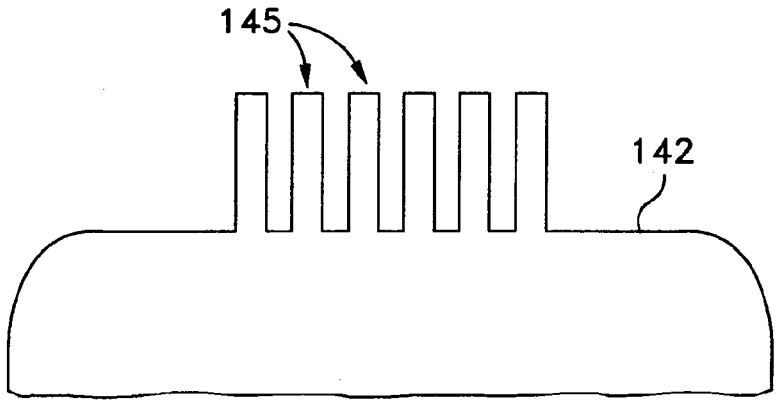
FIG. 21 is a view of one portion of the embodiment depicted in FIG. 20.

The two sections of the clipboard would be hinged at one end of the board with a clip at the opposite end for connecting the two sections in detachable fashion. FIG. 20 provides a partial side view of a hinging mechanism 139 that could be used to connect two parts 141 and 142 of a bifurcated or two-part clipboard 143. The mechanism consists of inter-digital projections 145 that project out of the end of the clipboard 143, FIG. 21. As depicted in a side view in FIG. 20 they end in disk shaped members 147. They are on both adjacent edges of side 141 and 142. They interleave between each other and are connected by a shaft 149 that passes through holes in the center of the disks.

Figure 22:
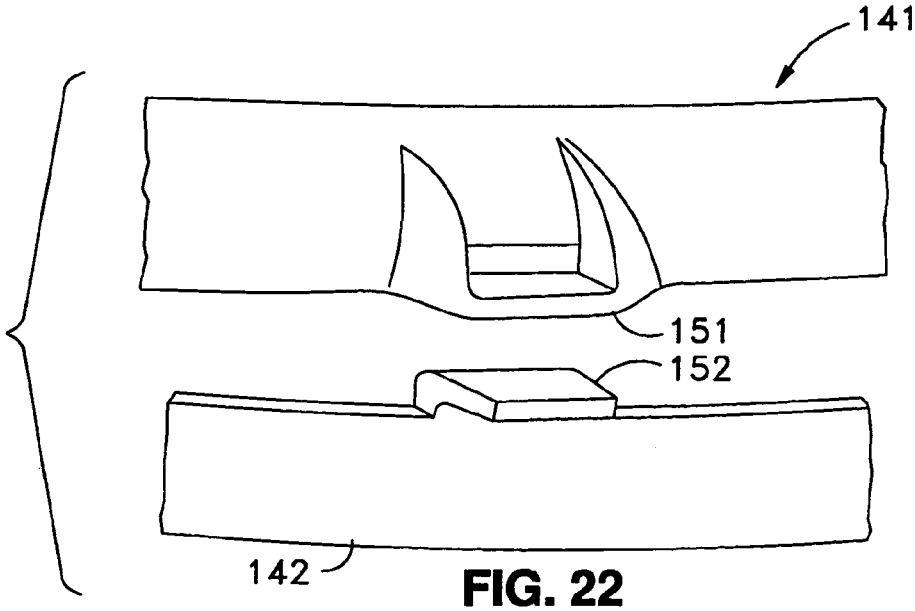
FIG. 22 is a view of a detachable connecting mechanism.

FIG. 22 provides a view of the clipping mechanism 151 and 152 that might be at the opposite adjacent edges of side or lid 141 and case 142 of clipboard 131. Any number of other different type of secure but detachable clipping mechanisms can be used. For instance another mechanism, not shown could be a Velcro™ strap type of mechanism, not shown.

OTHER EMBODIMENTS OF INVENTION

Figure 23:
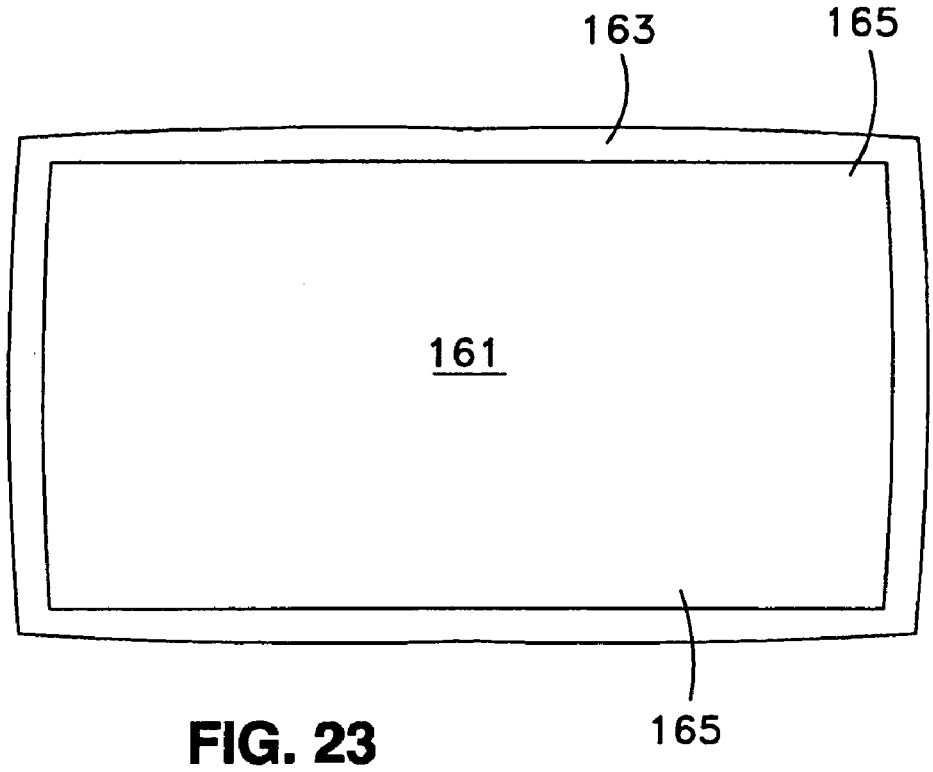
FIG. 23 is a front raised view of one of the basic structures of the present invention.
Figure 24:
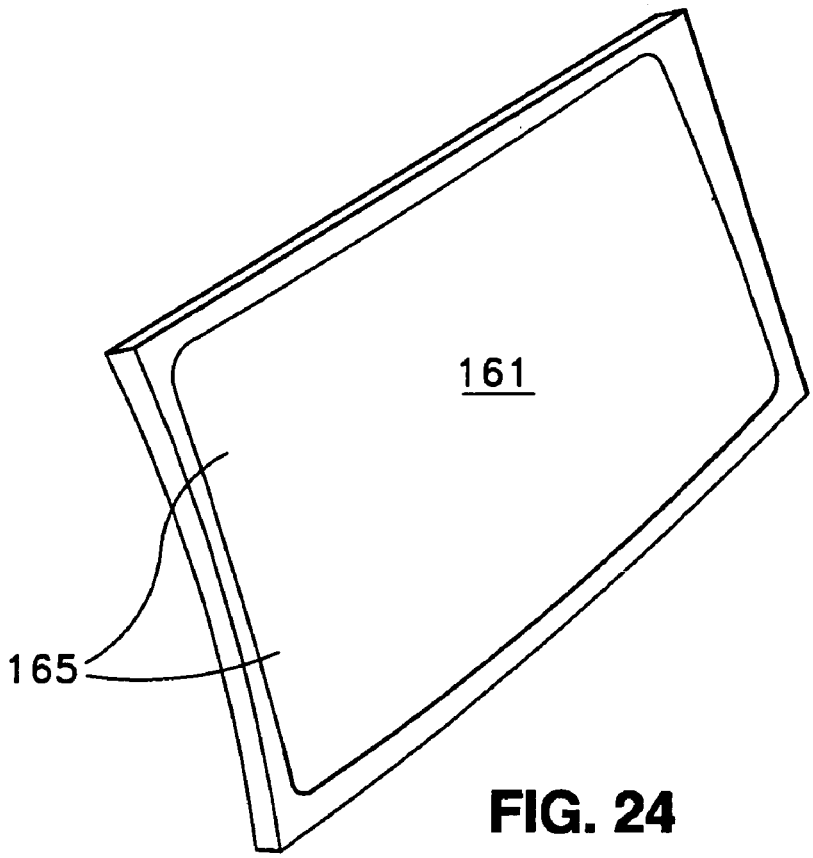
FIG. 24 is a perspective view of the embodiment of FIG. 23.

One of the keys to the present invention is providing a barrier made up of multiple flexible sheet of bullets resistant material. The barrier of multiple flexible sheets 161 is held in a typically planar configuration 131, FIGS. 23 and 24, are held in place by a frame 163. This lets the sheets of bullet resistant material 161 flex when impacted by a bullet. The edges 165 can be connected to frame 163 in any number of ways. They can fit into a clamping grove on frame 163, mated groves on a two part frame that sandwiches the edges between them or be glued to the frame with appropriate glue as discussed above. The important aspect of the connection at the edge is that it be permanent and capable of withstanding the substantial force that will be exerted on the connection to the frame when a bullet impacts the bullet resistant material and flexes the multiple sheets 161.

Figure 25:
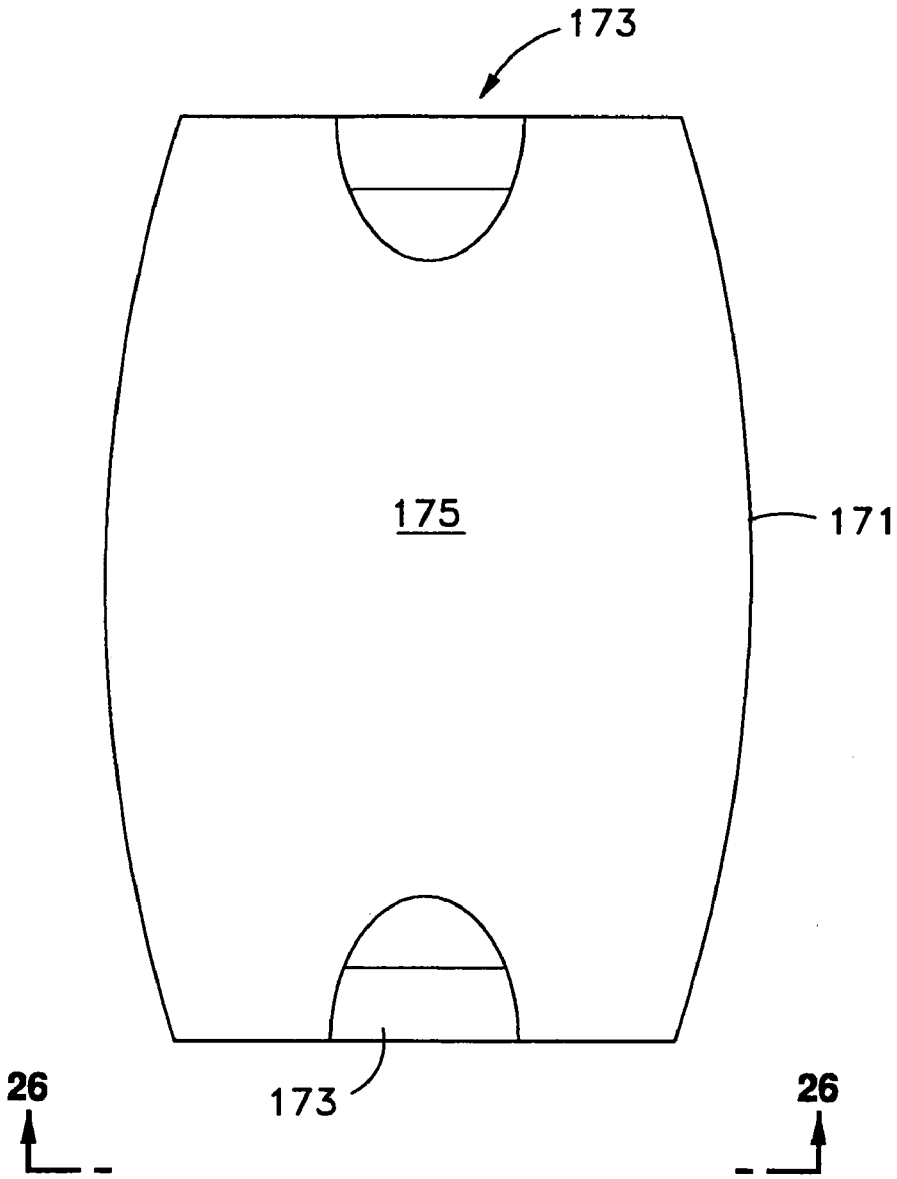
FIG. 25 is a review of another embodiment of the present invention.
Figure 26:
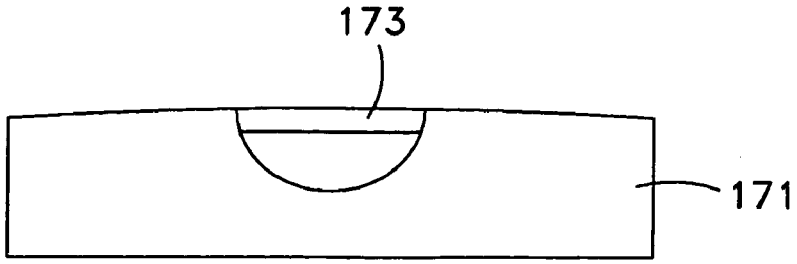
FIG. 26 is a view of the embodiment in FIG. 26 along line XXVI—XXVI of FIG. 25.

The general concept discussed above has many applications beyond use in a clipboard. One variation that uses it in a tray 171 is depicted in FIGS. 25 and 26. FIG. 25 is a top view of tray 171 and FIG. 26 is an end view along line 26. Tray 171 has recessed handholds 173 at its top. Recessed hand holds 173 protect the hands of the person holding tray 171. Tray 171 would have a hollow interior, not shown that would have a multiple sheets of flexible bullet proof material as depicted in FIGS. 23 and 24 stretched across the interior in a plane parallel to the top surface 175 of tray 171 and a sufficient distance from top surface 175 to allow the bullet proof or resistant material to flex and catch a bullet that might impact the front, of tray 171.

The concept of the sheet of multiple layers of a bullet proof or resistant material can be employed in any number of situations where there are available hollow spaces. Inside the paneling of vehicles, such as the doors, roof or trunk are examples. They could also be incorporated into seat backs in vehicles. The sheet of multiple layers of a bullet proof or resistant material can be employed in the bottom of a helicopter to protect occupants from bullets fired from below, as well as in the side paneling of the helicopter.

There have been described above variations of the invention for purposes of illustrating the manner in which the present invention may be used to advantage. However, it will be appreciated that the invention is not limited thereto but includes all variations and modifications which may occur to those skilled in the art without violating the scope and spirit of the claims as appended hereto.

What is claimed is:

1. A bullet proof shield comprising:

a) a frame defining a planar interior space;

b) a plurality of layers of bullet proof material connected to said frame at peripheral edges of each layer of said bullet proof material to thereby form a planar array of a plurality of bullet proof layers across the interior space, said peripheral edges being connected to said frame to withstand substantial tensile force;

c) wherein space is provided on at least one side of the plurality of layers to allow each of said layers to stretch from a shear mode to a tensile mode in response to the layers being impacted by a bullet to thereby dissipate kinetic energy of the bullet and preventing the bullet from penetrating through the plurality of layers;

d) wherein said frame is enclosed within a case having hand grips on a first side of said case and a clip board on a second side of said case such that side shield including hand grips so said shield can be held in a protective posture to block bullets and said plurality of layers of bullet proof material are positioned between said first and second side; and e) wherein said case is bifurcated and said first side being on a first bifurcated part and said second side being a second bifurcated part, said first and second bifurcated part being hingedly connected along an adjacent edge of said first bifurcated part and an adjacent edge of said second bifurcated part.

2. The device of claim 1 wherein said first and second bifurcated part are hingedly connected by a reinforced hinging mechanism.

3. The device of claim 2 wherein said reinforced hinging mechanism is formed by a first set of intro-digital projections located on said adjacent edge of first bifurcated part and a second set of intro-digital projections located on said adjacent edge of said second bifurcated part and wherein said first set of intro-digital projections hingedly interlock with said second intro-digital projections.

* * * * *

UNITED STATES PATENT AND TRADEMARK OFFICE

CERTIFICATE OF CORRECTION

PATENT NO. : 7,146,899 B2
APPLICATION NO. : 10/861965
DATED : December 12, 2006
INVENTOR(S) : Imblum et al.

It is certified that error appears in the above-identified patent and that said Letters Patent is hereby corrected as shown below:

At column 1, line 50, please delete "drivers" and insert -- driver's --, therefor.

At column 3, line 36 (Approx.), please delete "users" and insert -- user's --, therefor.

At column 7, line 39, please delete "(F2)" and insert -- ($F_2$) --, therefor.

At column 7, line 46, please delete "(F1)" and insert -- ($F_1$) --, therefor.

At column 7, line 53, please delete "towering" and insert -- lowering --, therefor.

At column 12, line 39, in claim 1, after "that" please delete "side" and insert -- said --, therefor.

At column 12, line 47, in claim 1, please delete "part" and insert -- parts --, therefor.

At column 12, line 51, in claim 2, please delete "part" and insert -- parts --, therefor.

At column 12, line 55, in claim 3, after "edge of" please insert -- said --.

Signed and Sealed this

Tenth Day of June, 2008

JON W. DUDAS
*Director of the United States Patent and Trademark Office*